US010894312B2

(12) United States Patent
Blum et al.

(10) Patent No.: US 10,894,312 B2
(45) Date of Patent: Jan. 19, 2021

(54) MACHINE TOOL SYSTEM

(71) Applicant: Robert Bosch GmbH, Stuttgart (DE)

(72) Inventors: Jens Blum, Filderstadt (DE); Heiko Roehm, Stuttgart (DE); Joerg Welke, Ettlingen-Schoellbronn (DE); Tobias Herr, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 203 days.

(21) Appl. No.: 15/535,359

(22) PCT Filed: Nov. 9, 2015

(86) PCT No.: PCT/EP2015/076025
§ 371 (c)(1),
(2) Date: Jun. 12, 2017

(87) PCT Pub. No.: WO2016/096244
PCT Pub. Date: Jun. 23, 2016

(65) Prior Publication Data

US 2017/0348842 A1 Dec. 7, 2017

(30) Foreign Application Priority Data

Dec. 16, 2014 (DE) ..... 10 2014 226 089

(51) Int. Cl.
*B24B 23/02* (2006.01)
*B25F 5/02* (2006.01)
(Continued)

(52) U.S. Cl.
CPC ..... *B25F 5/02* (2013.01); *B24B 23/02* (2013.01); *B24B 23/03* (2013.01); *B24B 23/04* (2013.01); *B25F 5/00* (2013.01)

(58) Field of Classification Search
CPC ..... B24B 23/02; B24B 23/03; B24B 23/04; B25F 5/00; B25F 5/02
(Continued)

(56) References Cited

U.S. PATENT DOCUMENTS 4,158,246 A * 6/1979 Meadows ..... B24B 23/02 15/28
4,625,462 A * 12/1986 Fushiya ..... B24B 23/046 451/357
(Continued)

FOREIGN PATENT DOCUMENTS

CN 1754653 A 4/2006
CN 1754654 A 4/2006
(Continued)

OTHER PUBLICATIONS

International Search Report corresponding to PCT Application No. PCT/EP2015/076025, dated Nov. 9, 2015 (German and English language document) (7 pages).

*Primary Examiner* — Eileen P Morgan
(74) *Attorney, Agent, or Firm* — Maginot, Moore & Beck LLP

(57) ABSTRACT

A machine tool system includes at least one portable machine tool and at least one energy storage apparatus. The at least one portable machine tool includes at least one tool receptacle configured to be arrange a machining tool, and at least one receiving interface. The at least one energy storage apparatus is configured to be arranged on the at least one receiving interface of the at least one portable machine tool. At least in a state when the at least one energy storage apparatus is arranged on the at least one receiving interface, the at least one energy storage apparatus is arranged at least for the most part within a boundary region of the at least one tool receptacle.

16 Claims, 5 Drawing Sheets

(51) Int. Cl.
*B24B 23/04* (2006.01)
*B25F 5/00* (2006.01)
*B24B 23/03* (2006.01)

(58) Field of Classification Search
USPC ..... 451/357, 359
See application file for complete search history.

(56) References Cited

U.S. PATENT DOCUMENTS 5,423,102 A * 6/1995 Madison ..... A46B 13/04 15/22.1
6,971,951 B2 * 12/2005 Boyer ..... B24B 23/00 451/344
7,284,292 B2 * 10/2007 Jaffe ..... A46B 5/0008 15/22.1
7,707,674 B2 * 5/2010 Schonewille ..... A47L 13/26 15/28
8,122,554 B2 * 2/2012 Schemmel ..... A47L 13/26 15/24
8,192,254 B2 * 6/2012 Fukinuki ..... B24B 41/02 451/343
9,061,393 B2 * 6/2015 Sugita ..... B24B 23/03
9,114,500 B2 * 8/2015 Sugita ..... B24B 23/04
9,408,513 B2 * 8/2016 Elen ..... A47L 11/12
2004/0074025 A1 * 4/2004 Blaustein ..... B25F 3/00 15/23
2004/0103490 A1 * 6/2004 Long ..... A47L 11/125 15/22.1
2006/0068689 A1 * 3/2006 Kiss ..... B24B 23/04 451/359
2008/0254721 A1 * 10/2008 Wuensch ..... B24B 23/04 451/344
2009/0221222 A1 * 9/2009 Lo ..... B24B 23/02 451/359
2010/0009608 A1 * 1/2010 Lo ..... B24B 23/028 451/357
2010/0120340 A1 * 5/2010 Fukinuki ..... B24B 23/04 451/356
2014/0357165 A1 * 12/2014 Elen ..... A47L 11/12 451/344

FOREIGN PATENT DOCUMENTS

CN 202062287 U 12/2011
DE 10 2008 055 527 A1 6/2010
EP 2 607 016 A2 6/2013
JP 2009-166147 A 7/2009
WO 2014/119127 A1 8/2014
WO 2014119133 A1 8/2014

* cited by examiner

MACHINE TOOL SYSTEM

This application is a 35 U.S.C. § 371 National Stage Application of PCT/EP2015/076025, filed on Nov. 9, 2015, which claims the benefit of priority to Serial No. DE 10 2014 226 089.2, filed on Dec. 16, 2014 in Germany, the disclosures of which are incorporated herein by reference in their entirety.

BACKGROUND

EP 2 607 016 A2 has already disclosed a machine tool system which comprises a portable machine tool which has a tool receptacle for arranging a machining tool, and a receiving interface. Furthermore, the machine tool system comprises an energy storage apparatus which can be arranged on the receiving interface of the portable machine tool, in particular can be arranged removably on the receiving interface of the portable machine tool. In a state, in which it is arranged on the receiving interface, the energy storage apparatus is arranged at least for the most part outside a boundary region of the tool receptacle.

SUMMARY

The disclosure proceeds from a machine tool system having at least one portable machine tool which comprises at least one tool receptacle for arranging a machining tool, and at least one receiving interface, and having at least one energy storage apparatus which can be arranged on the receiving interface of the portable machine tool, in particular can be arranged removably on the receiving interface of the portable machine tool.

It is proposed that, at least in a state, in which it is arranged on the receiving interface, the energy storage apparatus is arranged at least for the most part within a boundary region of the tool receptacle. Here, a "boundary region of the tool receptacle" is to be understood to mean, in particular, a region, in particular a spatial region, which is swept over during a (in particular, imaginary) parallel displacement of at least one tool receiving face of the tool receptacle. Here, the term "tool receiving face" is to define, in particular, an area, in particular a maximum area, of the tool receptacle, against which the machining tool bears in a state, in which it is arranged on the tool receptacle, and/or which runs, in particular, at least substantially perpendicularly with respect to a movement axis of the tool receptacle. Here, the expression "substantially perpendicularly" is to define, in particular, an orientation of a direction relative to a reference direction, the direction and the reference direction enclosing an angle of 90°, in particular as viewed in one plane, and the angle having a maximum deviation of, in particular, less than 8°, advantageously less than 5° and particularly advantageously less than 2°. Here, the expression "at least for the most part within the boundary region" is to define, in particular, an arrangement of an element, in particular of the energy storage apparatus, more than 80% in particular, preferably more than 85% and particularly preferably more than 95% of an overall volume of the element, in particular of the energy storage apparatus, being arranged within the boundary region. In a state, in which it is arranged on the receiving interface, the energy storage apparatus is very particularly preferably arranged completely within the boundary region, 100%, in particular, of the overall volume of the energy storage apparatus being arranged completely within the boundary region of the tool receptacle of the portable machine tool.

Here, a "portable machine tool" is to be understood to mean, in particular, a machine tool for machining workplaces, which machine tool can be transported by an operator without a transport machine. The portable machine tool has, in particular, a mass which is smaller than 40 kg, preferably smaller than 10 kg and particularly preferably smaller than 5 kg. The machine tool can be configured as a portable angle grinder, as a hand-held circular saw, as a drill, as an impact drill, as a jigsaw, as a multi-functional machine, as a planing machine, as a router, or as another machine tool which appears appropriate to a person skilled in the art, in particular as an electrically operable portable machine tool. The portable machine tool is particularly preferably configured as a grinding machine, such as a rotary sander, an orbital sander or the like. The tool receptacle of the portable machine tool is preferably configured as a grinding disk or as an orbital plate, on which the machining tool, in particular a sanding sheet, can be arranged releasably. The portable machine tool preferably comprises at least one fixing unit which is provided to fasten the machining tool to the tool receptacle, in particular to fasten it releasably to the tool receptacle by means of a positively locking and/or non-positive connection. The fixing unit can be configured as a clamping unit, as a hook and loop fastener unit, as an adhesive unit, as a latching unit or as another fixing unit which appears appropriate to a person skilled in the art. "Provided" is to be understood to mean, in particular, specially designed and/or specially equipped. The fact that an element and/or a unit are/is provided for a defined function is to be understood to mean, in particular, that the element and/or the unit fulfill/fulfills and/or perform/performs this defined function in at least one use and/or operating state.

Here, a "receiving interface" is to be understood to mean, in particular, an interface which is provided at least for receiving an element and/or a unit, in particular the energy storage apparatus, in a positively locking and/or non-positive manner. At least one electric contact element of the portable machine tool is preferably arranged on the receiving interface, which electric contact element is provided for electric connection to a counter-contact element of the energy storage apparatus. The energy storage apparatus is preferably configured as an accumulator battery apparatus. The energy storage apparatus preferably comprises a multiplicity of rechargeable energy storage cells which are connected electrically to one another. The energy storage apparatus is particularly preferably configured as a removable accumulator battery pack.

An arrangement of the energy storage apparatus close to the center of the portable machine tool can advantageously be made possible by means of the configuration according to the disclosure. An optimized arrangement of the center of mass with regard to a movement axis of the tool receptacle can advantageously be achieved. Therefore, in particular in the case of a configuration of the portable machine tool as a grinding machine, a tendency to tilt of the portable machine tool when machining a workpiece can particularly advantageously be kept low. Therefore, precise machining of workpieces can advantageously be made possible. Furthermore, a large use spectrum of the portable machine tool can advantageously be realized as a consequence of a low projecting length of the energy storage apparatus beyond the boundary region, in particular beyond the tool receptacle. An advantageous corner accessibility can be achieved in as far as possible all orientation positions of the portable machine tool which are possible about the movement axis of the tool receptacle.

Furthermore, it is proposed that the tool receptacle has an axis which runs through a centroid of a tool receiving face of the tool receptacle, runs at least substantially perpendicularly with respect to the tool receiving face, and intersects the energy storage apparatus. The tool receiving face of the tool receptacle is preferably arranged on a side of the tool receptacle, which side faces away from a drive unit and/or a housing unit of the portable machine tool. The tool receiving face can have any configuration which appears appropriate to a person skilled in the art. The tool receiving face is preferably of circular or polygonal, in particular rectangular or triangular, configuration. The axis which runs through a centroid of a tool receiving face of the tool receptacle preferably runs at least substantially parallel, in particular coaxially, with respect to a movement axis of the tool receptacle. Here, "substantially parallel" is to be understood to mean, in particular, an orientation of a direction relative to a reference direction, in particular in one plane, the direction having a deviation, in particular, of less than 8°, advantageously of less than 5° and particularly advantageously of less than 2° with respect to the reference direction. By means of the configuration according to the disclosure, an arrangement of the energy storage apparatus close to a center of the tool receptacle can particularly advantageously be realized. A low tendency to tilt of the portable machine tool can advantageously be achieved.

It is proposed, furthermore, that, at least in a state, in which it is arranged on the receiving interface, the energy storage apparatus is arranged between a handle region of a housing unit of the portable machine tool and the tool receptacle, as viewed along a movement axis of the tool receptacle. The movement axis of the tool receptacle is preferably configured as a rotational axis. The tool receptacle preferably rotates about the rotational axis, in particular eccentrically about the rotational axis, and/or the tool receptacle oscillates about the rotational axis, in particular eccentrically about the rotational axis. The portable machine tool can comprise a switchable gear mechanism unit which is provided to change a rotational speed and/or an oscillation speed of the tool receptacle. Here, a "handle region" is to be understood to mean, in particular, a region of the housing unit, on which an operator arranges at least one hand during correct operation of the portable machine tool. The handle region is preferably provided for the arrangement of a hand inner face. The handle region is preferably arranged on the housing unit on a side of the housing unit, which side faces away from the tool receptacle. A grip face, in particular a rubberized grip face, of the portable machine tool is preferably arranged in the handle region. The housing unit can have a shell design and/or a cup design. By means of the configuration according to the disclosure, a weight of the energy supply apparatus can advantageously be utilized to support an operator for pressing the portable machine tool onto a workpiece to be machined. A weight of the energy supply apparatus can advantageously be utilized as an additional centric pressing force.

In addition, it is proposed that, at least in a state, in which it is arranged on the receiving interface, the energy storage apparatus is covered at least partially on at least two sides by a housing unit of the portable machine tool. At least in a state, in which it is arranged on the receiving interface, the energy storage apparatus is preferably covered on at least two sides by a housing unit of the portable machine tool, as viewed along the movement axis of the tool receptacle. Here, "cover" is to be understood to mean, in particular, an arrangement of a plurality of elements relative to one another, an imaginary axis intersecting all elements, in particular at least in each case at one point of the respective element. The axis which runs through the centroid of the tool receiving face of the tool receptacle preferably intersects the housing unit and the energy storage apparatus. By means of the configuration according to the disclosure, a structurally simple arrangement of the energy apparatus in a near region of the movement axis of the tool receptacle can advantageously be made possible. An advantageous optimization of an arrangement of a center of mass of the portable machine tool can be achieved, which optimization makes high operator and/or machining comfort possible. Furthermore, reliable protection, in particular impact protection, of the energy storage apparatus can advantageously be made possible in a state, in which it is arranged on the receiving interface.

Furthermore, it is proposed that, at least in a state, in which it is arranged on the receiving interface, the energy storage apparatus is arranged at least partially between a handle region of a housing unit of the portable machine tool and a drive unit of the portable machine tool, as viewed along a movement axis of the tool receptacle. The drive unit is preferably configured as an electric motor unit. It is also conceivable, however, that the drive unit has another configuration which appears appropriate to a person skilled in the art, such as a pneumatic motor unit, an internal combustion engine unit, a hybrid motor unit or the like. At least in a state, in which it is arranged on the receiving interface, the energy storage apparatus is preferably arranged between the handle region and the drive unit in such a way that the handle region is arranged on a side of the energy storage apparatus, which side faces away from the tool receptacle, and the drive unit is arranged on a side of the energy storage apparatus, which side faces the tool receptacle. It is also conceivable, however, that, at least in a state, in which it is arranged on the receiving interface, the energy storage apparatus is arranged between the handle region and the drive unit in such a way that the handle region is arranged on a side of the energy storage apparatus, which side faces the tool receptacle, and the drive unit is arranged on a side of the energy storage apparatus, which side faces away from the tool receptacle. By means of the configuration according to the disclosure, an arrangement of the drive unit and the energy storage apparatus can advantageously be made possible, which arrangement is optimized with regard to an arrangement of a center of mass of the portable machine tool.

Furthermore, it is proposed that, at least in a state, in which it is arranged on the receiving interface, the energy storage apparatus, in particular in an alternative configuration of the portable machine tool and/or the machine tool system, is arranged offset laterally with respect to a drive unit of the portable machine tool, in particular in relation to the movement axis of the tool receptacle. An axis which runs at least substantially perpendicularly with respect to the movement axis of the tool receptacle preferably intersects the drive unit and the energy storage apparatus, in particular in a state of the energy storage apparatus, in which it is arranged on the receiving interface. By means of the configuration according to the disclosure, a compensation and/or an elimination of lever forces which are caused by way of a weight of the drive unit and by way of a weight of the energy storage apparatus and might lead to an inclination to tilt of the tool receptacle can advantageously be made possible.

In addition, it is proposed that a drive unit of the portable machine tool is arranged offset laterally with respect to a movement axis of the tool receptacle. A drive axis of the drive unit preferably runs at least substantially parallel to the movement axis of the tool receptacle. The drive axis of the drive unit is preferably arranged spaced apart relative to the movement axis of the tool receptacle. By means of the configuration according to the disclosure, an arrangement of a center of mass in the region of the movement axis of the tool receptacle can advantageously be realized, it being possible for a compensation of forces of the drive unit which act eccentrically to be achieved as a consequence of an arrangement of the energy storage apparatus on the receiving interface of the portable machine tool.

Furthermore, it is proposed that the receiving interface has at least one guide element which has a longitudinal axis which runs at least substantially transversely with respect to a movement axis of the tool receptacle. Here, "substantially transversely" is to be understood to mean, in particular, an orientation of a direction and/or an axis relative to a reference direction and/or a reference axis, the orientation of the direction and/or the axis being at least different from an at least substantially parallel orientation with respect to the reference direction and/or with respect to the reference axis and, in particular, being crooked or perpendicular with respect to the reference direction and/or with respect to the reference axis. The longitudinal axis and the movement axis of the tool receptacle particularly preferably enclose an angle of 90°, in particular in the case of a projection of the longitudinal axis and the movement axis of the tool receptacle into one plane. It is also conceivable in one alternative configuration of the machine tool system, however, that the receiving interface has at least one guide element which has a longitudinal axis which runs at least substantially parallel to a movement axis of the tool receptacle. By means of the configuration according to the disclosure, a compact arrangement of the energy storage apparatus can advantageously be realized, which compact arrangement makes an advantageous optimization of an arrangement of a center of mass in a close region of a movement axis of the tool receptacle possible.

Furthermore, it is proposed that the longitudinal axis of the guide element runs at least substantially parallel to a tool receiving face of the tool receptacle. An optimum arrangement of a center of mass of the portable machine tool can advantageously be achieved, in particular in order to make a low tendency to tilt of the portable machine tool during machining of a workpiece possible.

In addition, a portable machine tool, in particular a grinding machine, of a machine tool system according to the disclosure is proposed. By means of the configuration according to the disclosure, an arrangement of the energy storage apparatus close to the center of the portable machine tool can advantageously be made possible. An optimized arrangement of the center of mass can be achieved with regard to a movement axis of the tool receptacle. Therefore, in particular in the case of a configuration of the portable machine tool as a grinding machine, a tendency to tilt of the portable machine tool during machining of a workpiece can particularly advantageously be kept low. Therefore, precise machining of workpieces can advantageously be made possible. Furthermore, a great use spectrum of the portable machine tool can advantageously be realized as a consequence of a low projecting length of the energy storage apparatus beyond the boundary region, in particular beyond the tool receptacle. An advantageous corner accessibility in as far as possible all orientation positions of the portable machine tool can be achieved.

Here, the machine tool system according to the disclosure and/or the machine tool according to the disclosure are/is not to be restricted to the above-described use and embodiment. In particular, the machine tool system according to the disclosure and/or the machine tool according to the disclosure can have a number which differs from the number stated herein of individual elements, components and units in order to fulfill a method of operation which is described herein. In addition, in the case of the value ranges which are specified in this disclosure, values which lie within said limits are also to be considered disclosed and capable of being used as desired.

BRIEF DESCRIPTION OF THE DRAWINGS

Further advantages result from the following description of the drawing. Two exemplary embodiments of the disclosure are shown in the drawing. The drawing, the description and the claims contain numerous features in combination. A person skilled in the art will expediently also consider the features individually and combine them to form appropriate further combinations.

In the drawing.

DETAILED DESCRIPTION

Figure 1:
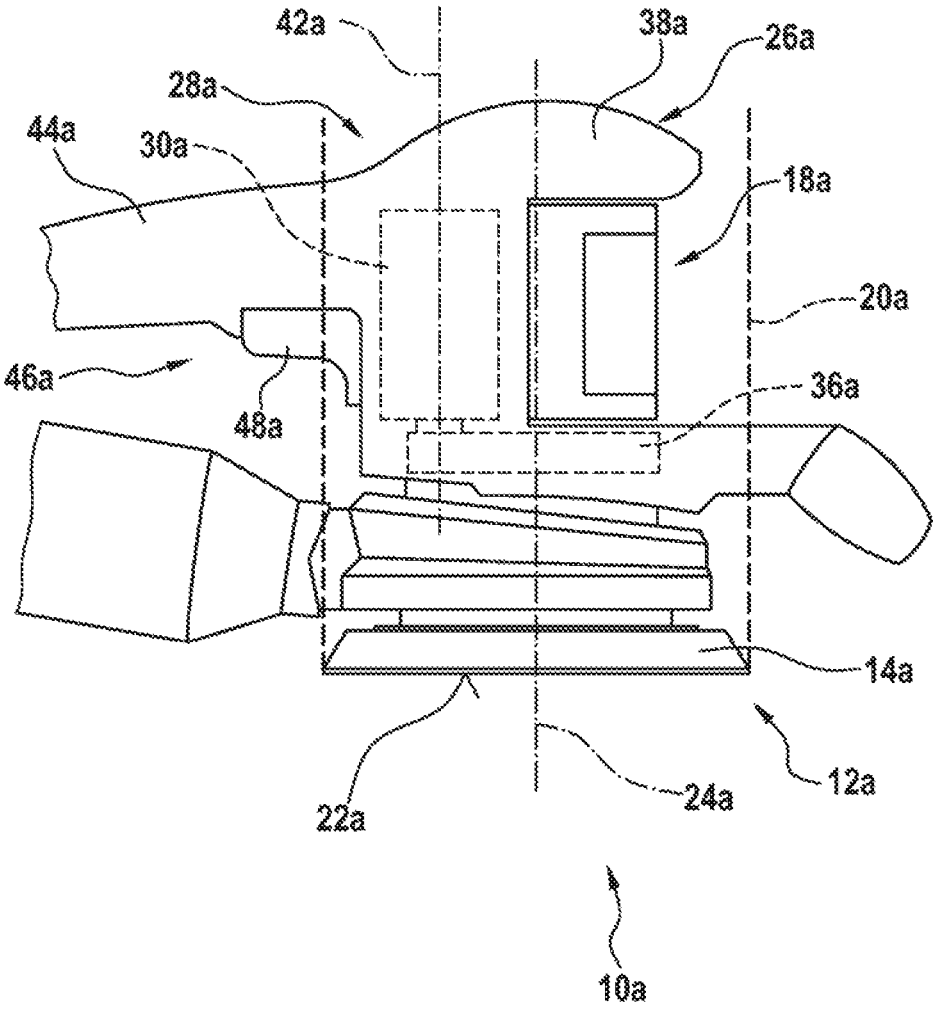
FIG. 1 shows a machine tool system according to the disclosure having at least one portable machine tool according to the disclosure and having at least one energy storage apparatus which is arranged on the portable machine tool, in a diagrammatic illustration.
Figure 2:
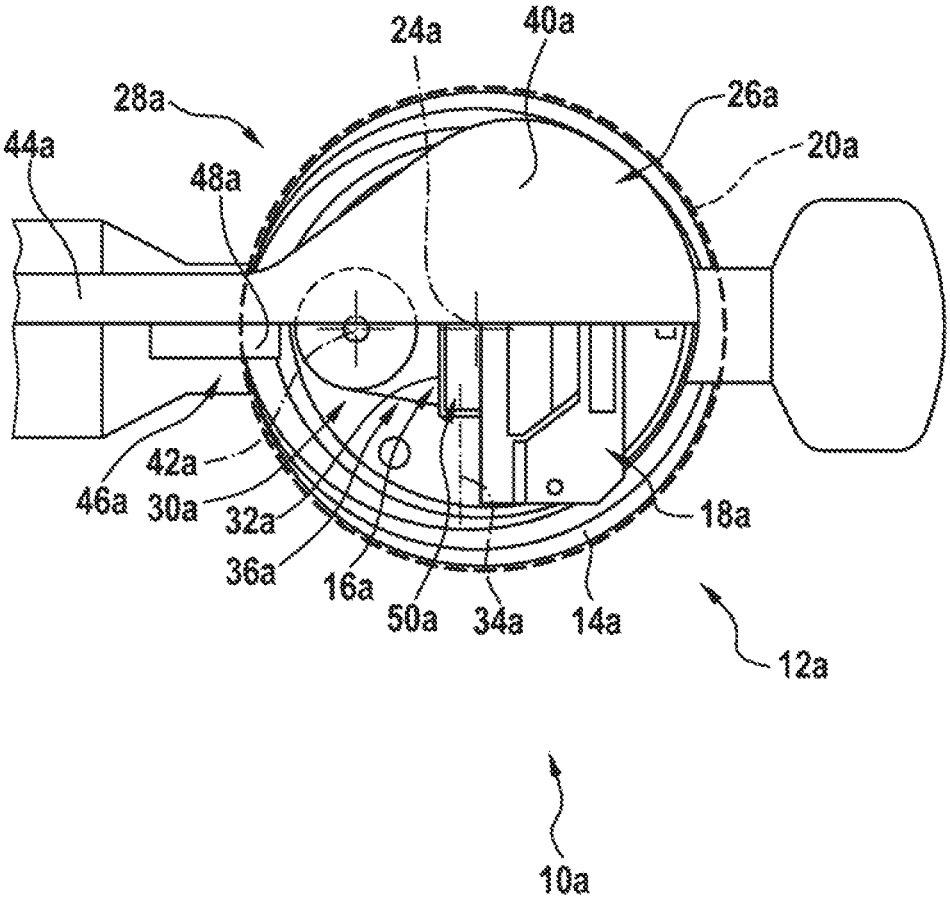
FIG. 2 shows a plan view of the machine tool system according to the disclosure, at least one housing element of a housing unit of the machine tool according to the disclosure being removed, in a diagrammatic illustration.
Figure 3:
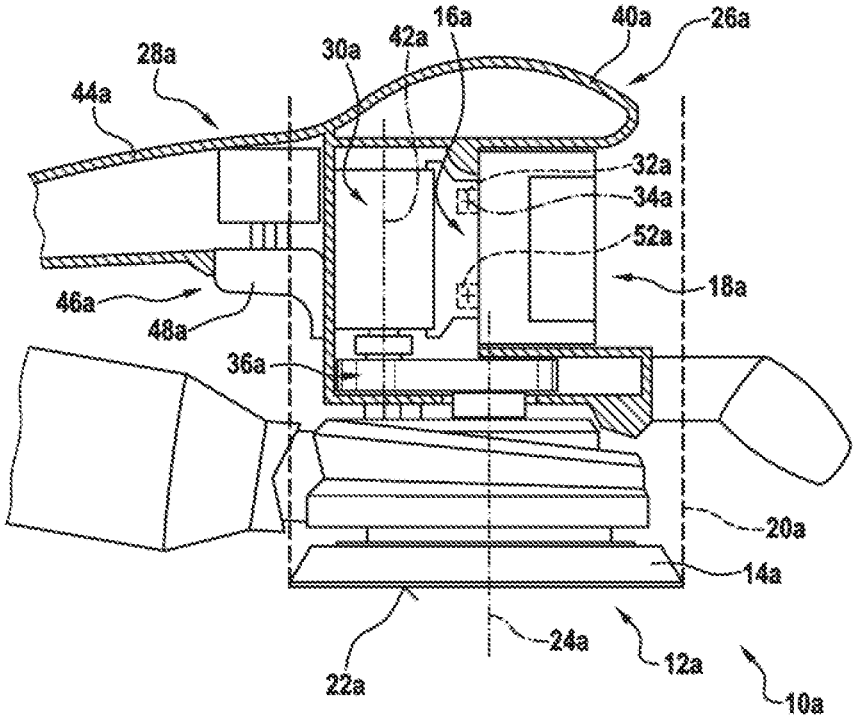
FIG. 3 shows a side view of the machine tool system according to the disclosure, at least the housing element of the housing unit of the machine tool according to the disclosure being removed, in a diagrammatic illustration.

FIGS. 1 to 3 show a machine tool system 10*a* having at least one portable machine tool 12*a* which comprises at least one tool receptacle 14*a* for arranging a machining tool (not shown in greater detail here), and at least one receiving interface 16*a*. In the exemplary embodiment which is shown in FIGS. 1 to 3, the portable machine tool 12*a* is configured as a grinding machine, in particular as a rotary sander. It is also conceivable, however, that the portable machine tool 12*a* has a different configuration which appears appropriate to a person skilled in the art, such as an orbital sander or the like. The portable machine tool 12*a* has at least one drive unit 30*a* which is provided to drive the tool receptacle 14*a* of the portable machine tool 12*a*. Furthermore, the portable machine tool 12*a* comprises at least one output unit 36*a*. The output unit 36*a* is configured as a wraparound output unit, in particular as a toothed belt output unit. It is also conceivable, however, that the output unit 36*a* is configured as a gearwheel output unit. The drive unit 30*a* and the output unit 36*a* are provided to drive the tool receptacle 14*a* in a manner which is already known to a person skilled in the art, in particular to drive it rotationally. The tool receptacle 14*a* can be driven by means of an interaction of the drive unit 30*a* and the output unit 36*a* in a manner which is already known to a person skilled in the art so as to rotate eccentrically about a movement axis 24*a*, in particular a rotational axis, of the tool receptacle 14*a*, it being possible, in particular, for a center of the tool receptacle 14*a* to be driven rotationally in an eccentric manner about the movement axis 24*a* of the tool receptacle 14*a* in addition to an overall rotation of the tool receptacle 14*a* about the movement axis 24*a* of the tool receptacle 14*a*. It is also conceivable, however, that the portable machine tool 12*a* is configured so as to be decoupled from the output unit 36*a*, and that the drive unit 30*a* is connected directly to the tool receptacle 14*a*.

The tool receptacle 14*a* is configured as an abrasive material receptacle, in particular as a grinding disk, on which the machining tool can be fixed by means of a fixing unit (not shown in greater detail here) of the portable machine tool 12*a* in a manner which is already known to a person skilled in the art. The fixing unit can be configured as a hook and loop closure unit, a clamping unit, a self-adhesive unit or the like. The machining tool is configured as a sanding sheet. It is also conceivable, however, that the machining tool has another configuration which appears appropriate to a person skilled in the art, such as a configuration as a polishing sheet, etc. In a state, in which it is arranged on the tool receptacle 14*a*, in particular in a state, in which it is fixed on the tool receptacle 14*a*, the machining tool bears against a tool receiving face 22*a* of the tool receptacle 14*a*. The tool receiving face 22*a* runs at least substantially perpendicularly with respect to the movement axis 24*a* of the tool receptacle 14*a*. The tool receiving face 22*a* is arranged on a side of the tool receptacle 14*a*, which side faces away from a housing unit 28*a* of the portable machine tool 12*a*.

The housing unit 28*a* is provided to receive at least the drive unit 30*a* and the output unit 36*a*. The housing unit 28*a* has a shell design. It is also conceivable, however, that the housing unit 28*a* has a cup design or a combination of a shell design and a cup design. The housing unit 28*a* comprises at least two housing shell elements 38*a*, 40*a* which can be fixed on one another. A connecting plane, in which the housing shell elements 38*a*, 40*a* bear against one another in a state, in which they are fixed against one another, runs at least substantially perpendicularly with respect to the tool receiving face 22*a*. In addition, the connecting plane, in which the housing shell elements 38*a*, 40*a* bear against one another in a state, in which they are fixed on one another, runs at least substantially parallel to the movement axis 24*a* of the tool receptacle 14*a*. The movement axis 24*a* of the tool receptacle 14*a* preferably runs in the connecting plane, in which the housing shell elements 38*a*, 40*a* bear against one another in a state, in which they are fixed on one another.

Furthermore, the movement axis 24*a* of the tool receptacle 14*a* runs at least substantially parallel to a drive axis 42*a* of the drive unit 30*a* (FIGS. 1 to 3). It is also conceivable, however, that the movement axis 24*a* of the tool receptacle 14*a* runs at least substantially transversely with respect to the drive axis 42*a* of the drive unit 30*a*. The drive unit 30*a* is configured as an electric motor unit. The drive axis 42*a* of the drive unit 30*a* is formed by a rotational axis of an armature shaft of the drive unit 30*a*. In addition, the output unit 36*a* is provided to mount the tool receptacle 14*a* such that it can be moved eccentrically relative to the movement axis 24*a* of the tool receptacle 14*a*. It is conceivable that the output unit 36*a* is of switchable configuration, in order, for example, to influence and/or to change a rotational speed of the tool receptacle 14*a*.

Furthermore, the machine tool system 10*a* has at least one energy storage apparatus 18*a* which can be arranged on the receiving interface 16*a* of the portable machine tool 12*a*, in particular can be arranged removably on the receiving interface 16*a* of the portable machine tool 12*a*. The energy storage apparatus 18*a* is configured as an accumulator battery apparatus. The energy storage apparatus 18*a* comprises a multiplicity of rechargeable accumulator battery cells (not shown in greater detail here). The accumulator battery cells of the energy storage apparatus 18*a* are arranged in a housing of the energy storage apparatus 18*a* in a manner which is already known to a person skilled in the art, and are connected electrically to one another. The energy storage apparatus 18*a* is configured as an accumulator battery pack which can be arranged removably on the receiving interface 16*a* of the portable machine tool 12*a*. It is also conceivable, however, that the energy storage apparatus 18*a* has another embodiment which appears appropriate to a person skilled in the art.

At least in a state, in which it is arranged on the receiving interface 16*a*, the energy storage apparatus 18*a* is arranged at least for the most part within a boundary region 20*a* of the tool receptacle 14*a*. The boundary region 20*a* is a spatial region which is formed by way of an imaginary parallel displacement of the tool receiving face 22*a* of the tool receptacle 14*a* along a direction which runs at least substantially parallel to the movement axis 24*a* of the tool receptacle 14*a*, in particular as a result of sweeping over a region starting from the tool receptacle 14*a* as far as an outer edge of the housing unit 28*a*, which outer edge is arranged on a side of the housing unit 28*a*, which side faces away from the tool receptacle 14*a*. In the exemplary embodiment which is shown in FIGS. 1 to 3, the tool receiving face 22*a* of the tool receptacle 14*a* has a circular configuration. The tool receiving face 22*a* of the tool receptacle 14*a* is configured as a circular face. It is also conceivable, however, that, in an alternative embodiment of the machine tool system 10*a*, in particular of the portable machine tool 12*a*, the tool receiving face 22*a* of the tool receptacle 14*a* has a different configuration which appears appropriate to a person skilled in the art, such as a polygonal configuration, in particular a rectangular or a triangular configuration or the like. The boundary region 20*a* of the tool receptacle 14*a* is formed as a circular-cylindrical, spatial region, the circumferential face of which is formed, in particular, as a consequence of an imaginary parallel displacement of an annular outer contour of the tool receiving face 22*a* of the tool receptacle 14*a* along the direction which runs at least substantially parallel to the movement axis 24*a* of the tool receptacle 14*a*.

Furthermore, the tool receptacle 14*a* has an axis which runs through a centroid of the tool receiving face 22*a* of the tool receptacle 14*a*, runs at least substantially perpendicularly with respect to the tool receiving face 22*a*, and intersects the energy storage apparatus 18*a* (FIG. 2). The axis which runs through a centroid of the tool receiving face 22*a* of the tool receptacle 14*a* runs at least substantially parallel to the movement axis 24*a* of the tool receptacle 14*a*. The centroid is configured as a circle center of the tool receiving face 22*a* of the tool receptacle 14*a*, in particular in the case of a circular configuration of the tool receiving face 22*a* of the tool receptacle 14*a*. The axis which runs through a centroid of the tool receiving face 22*a* of the tool receptacle 14*a* intersects the energy storage apparatus 18*a* at least in a contact and/or connecting region 50*a* of the energy storage apparatus 18*a*. The contact and/or connecting region 50*a* is provided for a positively locking and/or non-positive connection and/or for an electric connection of the energy storage apparatus 18*a* to the receiving interface 16*a*.

At least in a state, in which it is arranged on the receiving interface 16*a*, the energy storage apparatus 18*a* is preferably arranged completely within the boundary region 20*a* of the tool receptacle 14*a*. In a state, in which it is arranged on the receiving interface 16*a*, the energy storage apparatus 18*a* has a maximum extent, as viewed along a direction which runs at least substantially perpendicularly with respect to the movement axis 24*a* of the tool receptacle 14*a*, which maximum extent is smaller than a maximum extent of the tool receiving face 22*a* of the tool receptacle 14*a*, as viewed along the direction which runs at least substantially perpendicularly with respect to the movement axis 24*a* of the tool receptacle 14*a*. At least in a state, in which it is arranged on the receiving interface 16*a*, the energy storage apparatus 18*a* does not extend beyond the tool receptacle 14*a*, in particular does not extend beyond the tool receiving face 22*a*, as viewed along the direction which runs at least substantially perpendicularly with respect to the movement axis 24*a* of the tool receptacle 14*a*. The energy storage apparatus 18*a* is arranged at least for the most part, in particular completely, within the circumferential face of the boundary region 20*a* of the tool receptacle 14*a*, the circumferential face being formed, in particular, as a consequence of an imaginary parallel displacement of an annular outer contour of the tool receiving face 22*a* of the tool receptacle 14*a* along the direction which runs at least substantially parallel to the movement axis 24*a* of the tool receptacle 14*a*.

At least in a state, in which it is arranged on the receiving interface 16*a*, the energy storage apparatus 18*a* is arranged between a handle region 26*a* of the housing unit 28*a* of the portable machine tool 12*a* and the tool receptacle 14*a*, as viewed along the movement axis 24*a* of the tool receptacle 14*a*. The receiving interface 16*a* is arranged between the handle region 26*a* of the housing unit 28*a* of the portable machine tool 12*a* and the tool receptacle 14*a*, as viewed along the movement axis 24*a* of the tool receptacle 14*a*. The handle region 26*a* is arranged on the housing unit 28*a* on a side of the housing unit 28*a*, which side faces away from the tool receptacle 14*a*. The handle region 26*a* is provided as a rest face for a hand inner face of a hand of an operator of the portable machine tool 12*a*. A hand inner face of a hand of an operator can preferably be arranged on the handle region 26*a* in order to produce a pressing force during machining of a workpiece. The handle region 26*a* is formed by the housing shell elements 38*a*, 40*a*. The handle region 26*a* has a convex configuration. The handle region 26*a* is of spherical segment-shaped configuration. The handle region 26*a* is arranged at least for the most part within the boundary region 20*a* of the tool receptacle 14*a*.

In addition, the handle region 26*a* is configured in one piece with a shaft-shaped handle 44*a* of the housing unit 28*a*. An operating unit 46*a* of the portable machine tool 12*a* is arranged on the shaft-shaped handle 44*a*. The operating unit 46*a* is provided at least for activation or deactivation of a power supply and/or for influencing the rotational speed of the drive unit 30*a*. The operating unit 46*a* comprises at least one operating element 48*a* which is arranged on a side of the shaft-shaped handle 44*a*, which side faces the tool receptacle 14*a*. The shaft-shaped handle 44*a* extends beyond the boundary region 20*a* of the tool receptacle 14*a*, as viewed along the direction which runs at least substantially perpendicularly with respect to the movement axis 24*a* of the tool receptacle 14*a*.

Furthermore, at least in a state, in which it is arranged on the receiving interface 16*a*, the energy storage apparatus 18*a* is covered at least partially on at least two sides by the housing unit 28*a* of the portable machine tool 12*a*. The receiving interface 16*a* of the portable machine tool 12*a* is covered at least partially, in particular completely, on at least two sides by the housing unit 28*a* of the portable machine tool 12*a*. At least in a state, in which it is arranged on the receiving interface 16*a*, the energy storage apparatus 18*a* is covered at least partially on at least two sides by the housing unit 28*a* of the portable machine tool 12*a*, as viewed along the direction which runs at least substantially perpendicularly with respect to the movement axis 24*a* of the tool receptacle 14*a*. The receiving interface 16*a* of the portable machine tool 12*a* is covered at least partially, in particular completely, on at least two sides by the housing unit 28*a* of the portable machine tool 12*a*, as viewed along the direction which runs at least substantially perpendicularly with respect to the movement axis 24*a* of the tool receptacle 1*a*.

The receiving interface 16*a* comprises at least one guide element 32*a* (FIGS. 2 and 3) which has a longitudinal axis 34*a* which runs at least substantially transversely, in particular at least substantially perpendicularly, with respect to the movement axis 24*a* of the tool receptacle 14*a*. The longitudinal axis 34*a* of the guide element 32*a* runs at least substantially parallel to the tool receiving face 22*a* of the tool receptacle 14*a*. The guide element 32*a* is configured as a push-in guide groove which interacts for receiving the contact and/or connecting region 50*a* of the energy storage apparatus 18*a* which is of corresponding configuration to the guide element 32*a*, for arranging and/or making electrical contact with the energy storage apparatus 18*a* in a manner which is already known to a person skilled in the art. Overall, the receiving interface 16*a* has at least two guide elements 32*a*, 52*a* (FIG. 3). It is also conceivable, however, that the receiving interface 16*a* has a number of guide elements 32*a*, 52*a* which differs from two. The guide elements 32*a*, 52*a* have an at least substantially analogous configuration. In particular, the guide elements 32*a*, 52*a* are arranged and/or configured in a mirror-symmetrical manner.

Furthermore, at least in a state, in which it is arranged on the receiving interface 16*a*, the energy storage apparatus 18*a* is arranged offset laterally with respect to the drive unit 30*a* of the portable machine tool 12*a* (FIG. 3). The receiving interface 16*a* is arranged offset laterally with respect to the drive unit 30*a* of the portable machine tool 12*a*. At least in a state of the energy storage apparatus 18*a*, in which it is arranged on the receiving interface 16*a*, the drive unit 30*a* is at a spacing from the energy storage apparatus 18*a*, as viewed along the direction which runs at least substantially perpendicularly with respect to the movement axis 24*a* of the tool receptacle 14*a*. The drive unit 30*a* of the portable machine tool 12*a* is arranged offset laterally with respect to the movement axis 24*a* of the tool receptacle 14*a*.

Figure 4:
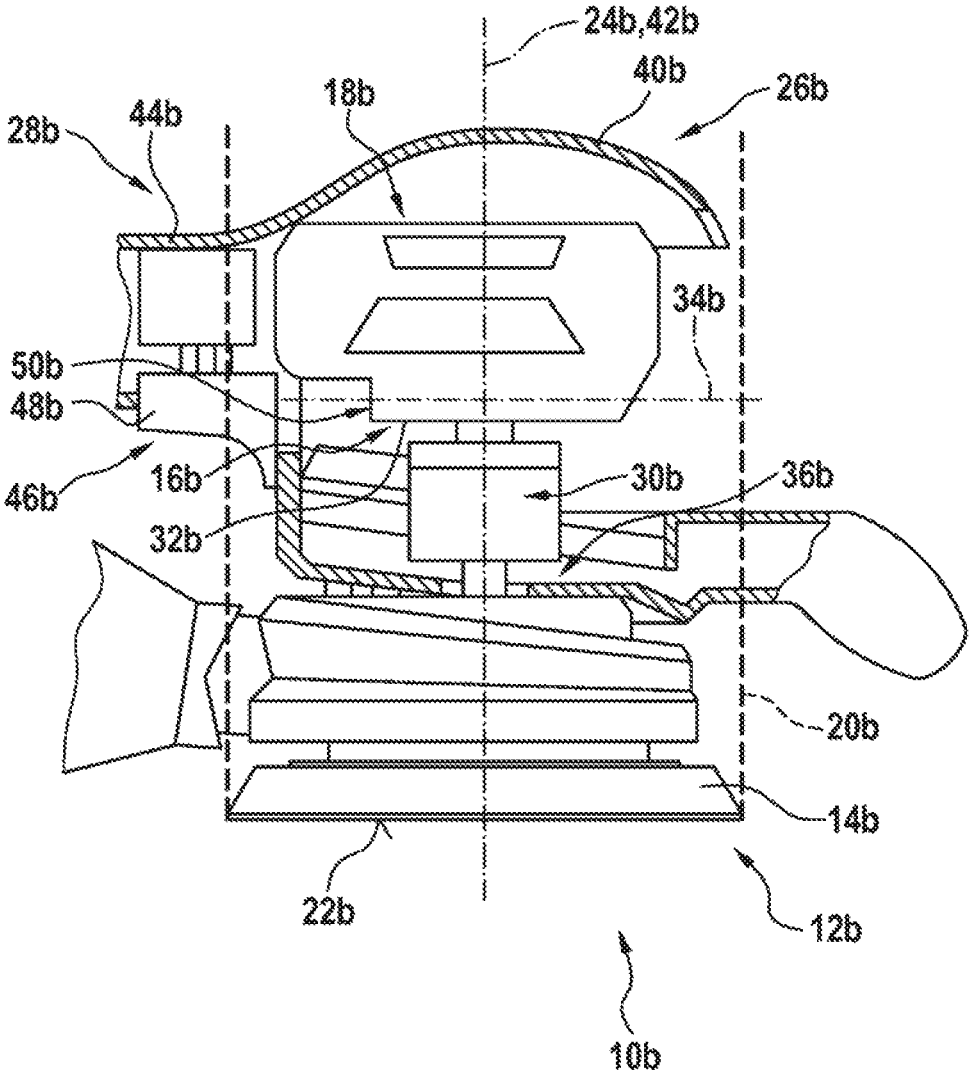
FIG. 4 shows an alternative machine tool system according to the disclosure having at least one alternative portable machine tool and having at least one energy storage apparatus which is arranged on the portable machine tool, in a diagrammatic illustration.
Figure 5:
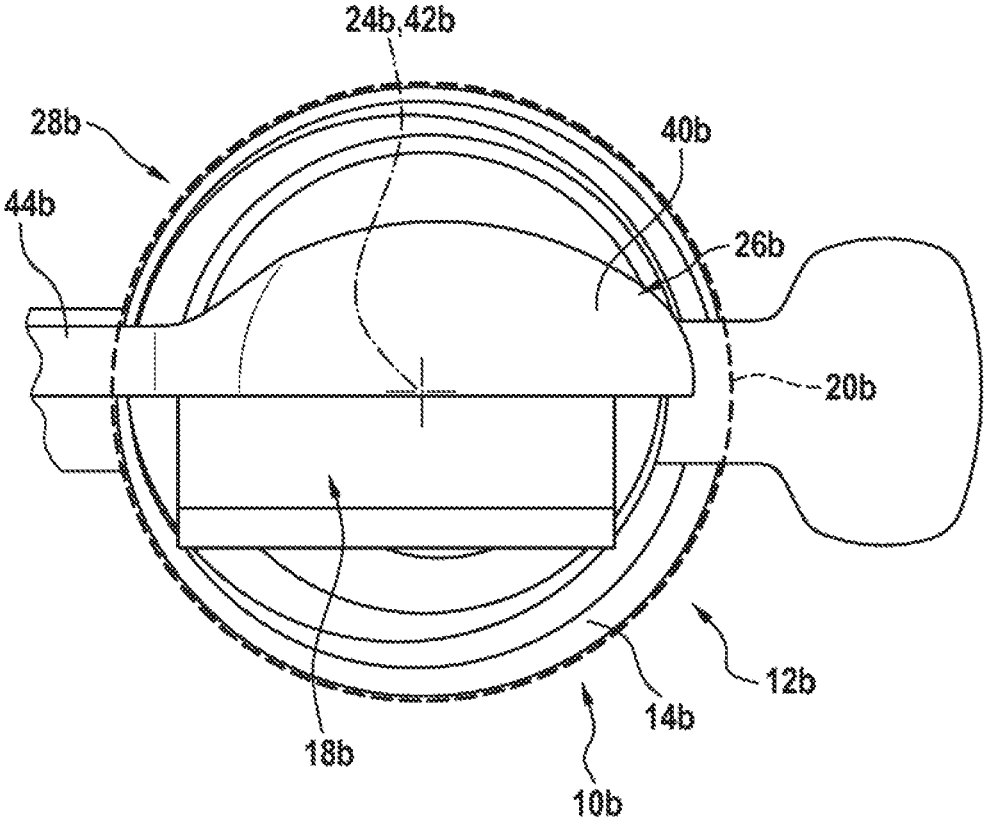
FIG. 5 shows a plan view of the alternative machine tool system according to the disclosure, at least one housing element of a housing unit of the alternative machine tool according to the disclosure being removed, in a diagrammatic illustration.

FIGS. 4 and 5 show a further exemplary embodiment of the disclosure. The following descriptions and the drawing are restricted substantially to the differences between the exemplary embodiments, it being possible fundamentally for reference also to be made to the drawing and/or the description of the other exemplary embodiment of FIGS. 1 to 3 with regard to components of identical designation, in particular in relation to components with identical reference signs. In order to distinguish the exemplary embodiments, the letter a is placed behind the reference signs of the exemplary embodiment in FIGS. 1 to 3. The letter a is replaced by the letter b in the exemplary embodiment of FIGS. 4 and 5.

FIGS. 4 and 5 show an alternative machine tool system 10*b* having at least one alternative portable machine tool 12*b* which comprises at least one tool receptacle 14*b* for arranging a machining tool (not shown in greater detail here), and at least one receiving interface 16*b*. Furthermore, the machine tool system 10*b* comprises at least one energy storage apparatus 18*b* which can be arranged on the receiving interface 16*b* of the portable machine tool 12*b*, in particular can be arranged removably on the receiving interface 16*b* of the portable machine tool 12*b*. The machine tool system 10*b* which is shown in FIGS. 4 and 5 has an at least substantially analogous configuration to the machine tool system 10*a* which is shown in FIGS. 1 to 3. In contrast to the machine tool system 10*a* which is shown in FIGS. 1 to 3, the machine tool system 10*b* which is shown in FIGS. 4 and 5 comprises the energy storage apparatus 18*b* which, at least in a state, in which it is arranged on the receiving interface 16*b* is arranged at least partially between a handle region 26*b* of a housing unit 28*b* of the portable machine tool 12*b* and a drive unit 30*b* of the portable machine tool 12*b* (FIG. 4), as viewed along a movement axis 24*b* of the tool receptacle 14*b*. In a state of the energy storage apparatus 18*b*, in which it is arranged on the receiving interface 16*b*, the drive unit 30*b* is arranged in the housing unit 28*b* on a side of the energy storage apparatus 18*b*, which side faces the tool receptacle 14*b*. A drive axis 42*b* of the drive unit 30*b* runs coaxially with respect to the movement axis 24*b* of the tool receptacle 14*b*. In a state of the energy storage apparatus 18*b*, in which it is arranged on the receiving interface 16*b*, the handle region 26*b* is arranged on the housing unit 28*b* on a side of the energy storage apparatus 18*b*, which side faces away from the tool receptacle 14*b*. With regard to further features and functions of the machine tool system 10*b* which is shown in FIGS. 4 and 5, reference may be made to the description of the machine tool system 10*a* which is shown in FIGS. 1 to 3.

The invention claimed is:

1. A machine tool system, comprising:

at least one portable machine tool including:

at least one tool receptacle having a tool receiving face configured for attachment of a machining tool; and at least one receiving interface;

at least one energy storage apparatus configured to be removably mounted to the at least one receiving interface of the at least one portable machine tool, wherein, at least in a state when the at least one energy storage apparatus is arranged on the at least one receiving interface, at least 80% of a volume of the at least one energy storage apparatus is arranged within a boundary region that is defined by an outer extent of the tool receiving face extended in a direction perpendicular to the tool receiving face.

2. The machine tool system as claimed in claim 1, wherein the at least one tool receptacle defines an axis that runs through a centroid of the tool receiving face of the at least one tool receptacle, runs at least substantially perpendicularly with respect to the tool receiving face, and intersects the at least one energy storage apparatus.

3. The machine tool system as claimed in claim 1, wherein, in a mounted state in which the at least one energy storage apparatus is mounted on the at least one receiving interface, the at least one energy storage apparatus is arranged between a handle region of a housing unit of the at least one portable machine tool and the at least one tool receptacle, along a movement axis of the at least one tool receptacle.

4. The machine tool system as claimed in claim 1, wherein, in a mounted state in which the at least one energy storage apparatus is mounted on the at least one receiving interface, the at least one energy storage apparatus is covered at least partially on at least two sides by a housing unit of the at least one portable machine tool.

5. The machine tool system as claimed in claim 1, wherein, in a mounted state in which the at least one energy storage apparatus is mounted on the at least one receiving interface, the at least one energy storage apparatus is arranged at least partially between a handle region of a housing unit of the at least one portable machine tool and a drive unit of the at least one portable machine tool, along a movement axis of the at least one tool receptacle.

6. The machine tool system as claimed in claim 1, wherein, in a mounted state in which the at least one energy storage apparatus is mounted on the at least one receiving interface, the at least one energy storage apparatus is arranged offset laterally with respect to a drive unit of the at least one portable machine tool.

7. The machine tool system as claimed in claim 1, wherein a drive unit of the at least one portable machine tool is arranged offset laterally with respect to a movement axis of the at least one tool receptacle.

8. The machine tool system as claimed in claim 1, wherein the at least one receiving interface includes at least one guide element defining a longitudinal axis that runs at least substantially transversely with respect to a movement axis of the at least one tool receptacle.

9. The machine tool system as claimed in claim 8, wherein the longitudinal axis of the at least one guide element runs at least substantially parallel to a tool receiving face of the at least one tool receptacle.

10. The machine tool system as claimed in claim 1, wherein the portable machine tool is configured as a grinding machine.

11. The machine tool system as claimed in claim 1, wherein the at least one energy storage apparatus is configured as a removable battery pack.

12. The machine tool system as claimed in claim 11, wherein, in a mounted state in which the removable battery pack is mounted to the at least one receiving interface, the removable battery pack is exposed outside a housing of the at least one portable machine tool.

13. The machine tool system as claimed in claim 1, wherein, in a mounted state in which the at least one energy storage apparatus is mounted to the at least one receiving interface, the at least one energy storage apparatus is exposed outside a housing of the at least one portable machine tool.

14. The machine tool system as claimed in claim 1, wherein at least 95% of the volume of the at least one energy storage apparatus is arranged within the boundary region.

15. The machine tool system as claimed in claim 14, wherein the entirety of the volume of the at least one energy storage apparatus is arranged within the boundary region.

16. The machine tool system as claimed in claim 8, wherein the at least one guide element is configured as a push-in guide groove configured to interact with at least one of a contact region and a connecting region of the at least one energy storage apparatus, and which is complementary to the at least one of the contact region and the connecting region.

* * * * *